US012397940B2

(12) United States Patent
Salvato et al.

(10) Patent No.: US 12,397,940 B2
(45) Date of Patent: Aug. 26, 2025

(54) METHOD AND BUNDLING UNIT FOR CARRYING OUT A MULTI-LAYERED PACKAGING SYSTEM

(71) Applicant: R.A Jones & Co., Covington, KY (US)

(72) Inventors: Anthony B. Salvato, Cincinnati, OH (US); R. Todd Gatman, Burlington, KY (US); Thorsten Simm, Florence, KY (US); Andrea Biondi, Bologna (IT); Luca Cavazza, Bologna (IT); Enrico Campagnoli, Bologna (IT)

(73) Assignee: R.A Jones & Co., Covington, KY (US)

( * ) Notice: Subject to any disclaimer, the term of this patent is extended or adjusted under 35 U.S.C. 154(b) by 120 days.

(21) Appl. No.: 18/245,785

(22) PCT Filed: Oct. 26, 2021

(86) PCT No.: PCT/IB2021/000785

§ 371 (c)(1),
(2) Date: Mar. 17, 2023

(87) PCT Pub. No.: WO2022/090808

PCT Pub. Date: May 5, 2022

(65) Prior Publication Data

US 2024/0025580 A1 Jan. 25, 2024

Related U.S. Application Data

(60) Provisional application No. 63/105,432, filed on Oct. 26, 2020.

(30) Foreign Application Priority Data

Oct. 30, 2020 (IT) ..... 102020000025939

(51) Int. Cl.
*B65B 35/30* (2006.01)
*B65B 5/06* (2006.01)
(Continued)

(52) U.S. Cl.
CPC ..... *B65B 5/06* (2013.01); *B65B 35/44* (2013.01); *B65B 35/50* (2013.01); *B65B 2220/16* (2013.01)

(58) Field of Classification Search
CPC ..... B65B 5/06; B65B 35/44; B65B 35/36; B65B 35/50; B65B 35/52; B65B 2220/16
See application file for complete search history.

(56) References Cited

U.S. PATENT DOCUMENTS 2,498,071 A * 2/1950 Dalziel ..... B65B 35/52 414/792.6
3,352,435 A * 11/1967 Reinecke ..... B65B 35/50 198/429
(Continued)

FOREIGN PATENT DOCUMENTS

GB 952320 A 3/1964

OTHER PUBLICATIONS

European Patent Office, International Search Report and Written Opinion of the International Searching Authority, International Application No. PCT/IB2021/000785, mailed Mar. 17, 2022 (9 pages).

(Continued)

*Primary Examiner* — Andrew M Tecco
(74) *Attorney, Agent, or Firm* — Wood Herron & Evans LLP

(57) ABSTRACT

A method for carrying out a multi-layered packaging system, comprising providing a plurality of packagings, moving said plurality of packagings by means of a first movement device, bringing a first group of packagings of said plurality of packagings into a collection zone (ZP), collecting by means of said transfer device having two degrees of freedom dais first group of packagings and moving said transfer device in accordance with a vertical component towards a bundling zone (ZA) of a bundling device to
(Continued)

activate a second retention element of said bundling device so as to collect said first group of packagings, moving again said transfer device into said collection zone (ZP) and starting to move said first movement device so as to bring a second group of packagings towards said collection zone (ZP) before said transfer device arrives in said collection zone (ZP), moving said transfer device by bringing said second group of packagings into said bundling zone (ZA) in such a manner that said second group of packagings vertically moves said first group of packagings by taking the position thereof and thereby forming said multi-layered packaging system.

19 Claims, 10 Drawing Sheets

(51) Int. Cl.
*B65B 35/44* (2006.01)
*B65B 35/50* (2006.01)

(56) References Cited

U.S. PATENT DOCUMENTS

| | | | | |
|---|---|---|---|---|
| 3,568,860 | A * | 3/1971 | Rawlins | B65G 57/306 271/178 |
| 5,088,883 | A * | 2/1992 | Focke | B65G 57/306 74/52 |
| 5,794,417 | A * | 8/1998 | Mohrman | B65B 5/06 53/496 |
| 2006/0288661 | A1* | 12/2006 | Allwein | B65B 35/52 53/529 |
| 2014/0345237 | A1* | 11/2014 | Tale | B65G 57/305 53/541 |

OTHER PUBLICATIONS

The International Bureau of WIPO, International Preliminary Report on Patentability, International Application No. PCT/IB2021/000785, mailed May 11, 2023 (8 pages).

* cited by examiner

METHOD AND BUNDLING UNIT FOR CARRYING OUT A MULTI-LAYERED PACKAGING SYSTEM

CROSS-REFERENCE TO RELATED APPLICATIONS

The present application is a submission under 35 U.S.C. § 371 of International Application No. PCT/IB2021/000785, filed Oct. 26, 2021, which claims priority to Italian Application No. 102020000025939, filed Oct. 30, 2020, and also claims the filing benefit of U.S. Provisional Application Ser. No. 63/105,432, filed Oct. 26, 2020, the disclosures of which are incorporated herein by reference in their entireties.

FIELD OF THE INVENTION

The present invention relates to a method and bundling unit for carrying out a multi-layered packaging system.

BACKGROUND OF THE INVENTION

In particular, the bundled packagings form a three-dimensional matrix which is intended to be inserted inside boxes such that their handling and storage are facilitated.

The present invention finds a preferred, though not exclusive, application in the field of the packagings that act as containers for loose articles such as, for example, capsules of infusion products such as coffee, a field to which reference may be made hereinafter without losing generality.

A packaging bundling device generally comprises retention devices suitable for securing and moving the packagings to be bundled.

Typically, these devices collect a certain number of packagings from a process line, move them onto a horizontal collection plane on which they create, by horizontally adding a certain plurality of further packagings, a desired three-dimensional arrangement of packagings, moving then this arrangement thus created towards subsequent steps of insertion into final box-like containers.

In this way, it is possible to prepare the desired three-dimensional arrangements of packagings on the horizontal collection plane by varying their extent according to the depth dimension.

In this context, a process is said to be "continuous" when at each time coordinate a first movement device that moves the plurality of packagings always has a speed different from zero.

In this context, the term "packaging" identifies a structure which is formed so as to be able to contain material within it and in particular to be able to confine it at least laterally. In this sense this term is understood as a synonym for "container".

In this context, the term "retention elements" identifies devices suitable for integrally and selectively securing one or more portions to them in such a way that, during the retention step, any movement of the retention element corresponds to an equal movement of the aforesaid portion of the container.

In this context, a first element is defined as "engaged" with a second element when an interaction is established between the two elements such that the first element is able to cause the movement of the second element. This interaction may be, for example, of a mechanical, magnetic type or other nature.

A plane is said "horizontal" when it is parallel to the plane of the ground in which the bundling unit subject-matter of the present invention is installed.

Consistently, the term "vertical" identifies a direction which is perpendicular to the horizontal plane and so must be understood the terms relating to "upper" or "lower" positionings that refer to an orientation in the vertical direction.

The term "vertical projection" means a projection of an element on a horizontal plane according to a vertical alignment. In this way, the projected element and its projection are vertically aligned. It will be possible for a vertical projection to undergo limited movements in the horizontal plane while maintaining the condition of substantial vertical alignment.

In this context, the term "bundling" identifies the operation of positioning a certain number of packagings in contact or close to each other in order to create a desired three-dimensional pattern or matrix. More specifically, reference will be made in this context to bundling as an operation whereby several layers of packagings are combined to form a multi-layered system.

The term "multi-layered" identifies a plurality of at least two layers of packagings.

The term "layer" identifies a one-dimensional matrix (i.e. a row) of packagings or a two-dimensional matrix (i.e. a plane) of packagings, which are arranged uniformly between them, which are then bundled to form a desired final three-dimensional matrix.

In this sense, therefore, such a three-dimensional matrix may be, purely by way of example, composed of three layers of one-dimensional rows each consisting of two packagings (thus creating a matrix of three rows by two columns) or, for example, of four layers of two-dimensional planes each consisting of four packagings arranged two by two (thus creating a matrix of four rows by two columns) or of equivalent three-dimensional matrices.

In this context, the term "three-dimensional matrix" identifies said three-dimensional pattern, considering that it is created by adding together different layers of packagings, i.e. different groups of packagings, which are one- or two-dimensional matrices.

In other words, the term "three-dimensional matrix" is used in this context to identify a multi-layered packaging system that can be made by bundling together one- or two-dimensional layers or combinations thereof in a desired direction.

It is appropriate to note that when reference is made to the plurality of packagings being moved, the packagings that will make up a one- or two-dimensional layer are identified as a "group".

In other words, in this context the term "group" of packagings identifies a specific finite set of packagings which is a characteristic subgroup of a plurality of packagings and which composes a specific layer of said three-dimensional matrix constituting the aforesaid multi-layered packaging system.

This three-dimensional matrix can have a parallelepiped, prismatic, truncated pyramidal or similar box shape.

The term "accumulation advancement" identifies a movement of packagings that proceeds by pressing the upstream packagings onto the downstream packagings. In this case, a fixed (not movable) transport surface is generally used, on which the packagings advance by sliding.

The Applicant has observed that the processes generally implemented by bundling apparatuses operating on packagings require them to be carried out in positions other than those identifiable for transport in the initial steps of the packagings.

In fact, the Applicant has observed that the bundling and the creation of the final three-dimensional arrangement of the packagings are carried out on a horizontal or inclined plane, called "magazine" or "buffer", adding packagings each time in order to achieve the desired three-dimensional arrangement which is then transported to a further processing station.

At the same time, however, the Applicant has found that this methodology involves the iterative creation of the three-dimensional arrangement on planes which are gradually more and more distant from a horizontal reference position which can be easily accessible to an operator.

In fact, the Applicant has noted that this spatial arrangement means that the last layers of the arrangements thus composed are in positions that are increasingly uncomfortable to reach for an operator who is standing next to the initial transport line of the packagings, thus leading to a reduced effectiveness of intervention should problems occur during the bundling step.

Even more, the Applicant has been able to ascertain from specific studies and simulations that this development of the arrangement of the various layers tends to make the single bundled layers hardly visible to the operator and therefore to mask possible problems or defects present during the bundling step.

Furthermore, the Applicant has noticed that this spatial arrangement adopted to create the bundling of the various layers requires the passage of the packagings over the buffer plane and thus results in a larger steric footprint of the process apparatus as a whole.

Even more critically, this step of bundling the packagings, which are moved on a different plane from the transport plane of the initial steps and from that of movement to the further processing steps, results in an excessively long movement step which thus leads to a loss of useful time and therefore a reduction in the potential productivity of the process apparatus used.

Further, the Applicant has noted that such operations for moving the packagings from the initial transport line to the buffer plane are carried out by temporarily blocking the transport devices until the retention element has returned to a predetermined initial position for collecting the next packagings to be moved.

This condition leads to an additional slowdown of the process, further reducing the productivity of the apparatus.

In addition, the Applicant has noted that a too high number of retention constraints and/or movement devices risks making the apparatus excessively bulky, rigid and heavy, thus also compromising the maximum speed of movement of the packagings and consequently the same productivity of the process.

The Applicant has therefore perceived that it was advantageous to spatially compact the packaging bundling process by increasing its productivity and increasing its control and the immediate accessibility to an operator, and that in order to do this it was necessary to develop a packaging bundling device completely different from the prior art.

Thanks to this approach, the Applicant has verified that it is possible to manage the various movement steps while bundling the desired multilayers more efficiently, as the need to move the packagings to be bundled on different planes is eliminated and the speed with which the different layers are brought to the bundling device is optimised.

The Applicant has finally found that the desired optimisation of the aforementioned processes is achieved by implementing a method for carrying out a multi-layered packaging system comprising the use of a transfer device having at least two degrees of freedom to move a first group of packagings which move according to a first advance direction, this transfer device being configured in such a way to move always avoiding to collide with said first movement device, in accordance with a vertical component towards a bundling zone of a bundling device which is positioned in a vertical projection of said collection zone, and by carrying out by means of said bundling device a vertical bundling of several layers which result to be a vertical sequence carried out on the vertical plane passing through the aforesaid first advance direction of the packagings.

In this way it is possible to minimise the movements of the packagings in order to achieve the desired bundling, while at the same time realising the condition of being able to move the transfer device in different directions in such a way as to reduce the stopping timings of the first movement device as much as possible.

SUMMARY OF THE INVENTION

In particular, in a first aspect thereof, the present invention relates to a method for carrying out a multi-layered packaging system.

Preferably, said method comprises providing a plurality of packagings.

Preferably, said method comprises moving said plurality of packagings in a first advance direction by means of a first movement device.

Preferably, said method comprises bringing a first group of packagings of said plurality of packagings into a collection zone of said first movement device.

Preferably, said method comprises providing a transfer device having at least two degrees of freedom comprising a first retention element for said first group of packagings.

Preferably, said method comprises collecting by means of said transfer device said first group of packagings from said collection zone.

Preferably, said method comprises moving said transfer device, while it retains said first group of packagings, in accordance with a vertical component towards a bundling zone of a bundling device which is positioned in a vertical projection of said collection zone.

Preferably, said method comprises activating a second retention element of said bundling device so as to collect said first group of packagings from said transfer device and to retain it selectively and stably in said bundling zone.

Preferably, said method comprises moving said transfer device into said collection zone while always maintaining a minimum distance different from zero with said first movement device and/or said plurality of packagings.

In other words, said method comprises moving said transfer device into said collection zone by travelling along a return trajectory different from a forward trajectory towards said bundling zone which thus avoids intersecting said first movement device and/or said plurality of packagings.

In this way it is therefore avoided that the transfer device, on its return path towards the collection zone, crosses the collection zone in which the packagings or the first movement device may possibly be present.

Preferably, said method comprises starting to move said first movement device so as to bring a second group of packagings towards said collection zone before said transfer device again arrives in said collection zone again.

Preferably, said method comprises completing said movement of said first movement device as far as said collection zone for said second group of packagings.

Preferably, said method comprises moving said transfer device in accordance with a vertical component by bringing said second group of packagings into said bundling zone of said bundling device while said second retention element is deactivated in such a manner that said second group of packagings vertically moves said first group of packagings by taking the position thereof and thereby forming said multi-layered packaging system.

Thanks to these features, it is possible to carry out a bundling step by combining several groups of packagings that are aligned on a vertical plane that has the first advance direction of the packagings as its axis. This significantly reduces the movements of the packagings required to make up the three-dimensional matrix, while at the same time the footprint of the first movement device, the transfer device and the bundling device are improved, which all lie on a single vertical plane.

Again thanks to this technical solution, the various layers are bundled by stacking a lower layer which, by moving towards the other one, takes the previous position of the upper layer and this operation can be effectively repeated a desired number of times until the desired three-dimensional matrix is carried out. From this condition, then, it is possible to send the three-dimensional matrix directly to the following boxing steps without further processings, thus improving the transfer timings of the process.

Furthermore, thanks to this technical solution it is possible for an operator who is standing beside the first movement device to effectively control the movement and the bundling of each single layer of packagings, allowing him to be able to intervene promptly if necessary.

Again, thanks to this present invention, it is possible to advance the first movement device even before the transfer device has completely returned to the collection position, thereby reducing the total process timings and thus improving overall productivity.

In fact, the transfer device travels along a path from the bundling zone to the collection position without crossing the collection zone, (arriving in the collection zone from the side opposite the bundling zone, i.e. from below) so that the first movement device can move the packagings into the collection zone without waiting for the transfer device to cross it to position itself under the new packagings to be transferred.

In a second aspect thereof, the present invention relates to a bundling unit for carrying out a multi-layered packaging system.

Preferably, this bundling unit comprises a first movement device for a plurality of packagings in a first advance direction.

Preferably, this first bundling device comprises a collection zone for said packagings.

Preferably, this bundling unit comprises a transfer device having two degrees of freedom, one of which is vertical.

Preferably, said transfer device comprises a first retention element for a first group of packagings of said plurality of packagings.

Preferably, said transfer device is positioned downstream of said first movement device.

Preferably, this bundling unit comprises a bundling device which is positioned substantially in a vertical projection of said collection zone.

Preferably, said bundling device comprises a second retention element which is configured so as to selectively retain said first group of packagings in a bundling zone.

Preferably, said transfer device is configured to move reversibly from said bundling zone to said collection zone while always maintaining a minimum distance different from zero with said first movement device.

Thanks to these characteristics, it is possible to bundle the various layers by stacking a lower layer in a vertical plane which, by moving towards the other one, takes the previous position of the upper layer until the desired three-dimensional matrix is created, thus improving the transfer timings of the process and reducing the total steric footprint of the unit.

Again, in this way the movements of the packagings necessary for the composition of the three-dimensional matrix are significantly reduced, thus increasing the production yield of the process.

Further, thanks to this technical solution it is possible for an operator who is standing beside the first movement device to effectively control the movement and the bundling of each single layer of packagings, enabling him to intervene promptly should a problem or process criticality be detected.

Moreover, thanks to the present invention it is possible to significantly reduce the total process timings by advancing the first movement device before the transfer device has completely returned to the collection position.

In fact, as said above, the transfer device travels along a path from the bundling zone to the collection position without crossing the collection zone, (arriving in the collection zone from the side opposite the bundling zone, i.e. from below) so that the first movement device can move the packagings into the collection zone without waiting for the transfer device to cross it to position itself under the new packagings to be transferred.

In at least one of the above-mentioned aspects, the present invention may also have at least one of the preferred features described below.

Preferably, said transfer device with two degrees of freedom has the ability to move along two axes which are contained in a vertical plane which is defined by a vertical axis and said first advance direction.

Thanks to this technical solution, the ergonomics of the bundling unit that carries out this method can be further increased, as in this way it is possible to further reduce the steric footprints of the transfer device and make the process more easily accessible to an operator in case of need.

Preferably, said transfer device is configured to move reversibly from said bundling zone to said collection zone along a path having a vertical component and a horizontal component which is parallel to said advance direction.

In this way, the transfer device can be moved away from the vertical projection of the collection zone and can be brought back under it without crossing it.

Preferably said first movement device comprises at least one web.

In this way the movement of the plurality of packagings is particularly effective, precise, simple, and economical.

Preferably, said first movement device comprises a web ending with a fixed accumulation plane on which the packagings are gathered. In this case, said collection zone is identified near an end portion of said fixed accumulation plane.

Preferably, the movement of said plurality of packagings takes place on the fixed accumulation plane by accumulation advancement.

Preferably, said first movement device proceeds with continuous motion.

In this way it is possible to avoid stopping and restarting said first movement device.

Alternatively, said first movement device proceeds uniformly.

In this way it is possible to define movement directions of said transfer device which provide for vertical movements close to the gradient while said plurality of packagings is substantially stationary.

Preferably, said transfer device with two degree of freedom comprises a piston which is vertically movable in translation and on which there is secured with permitted horizontal translational movement a movable lateral portion which is configured to act as the first retention element.

Thanks to this technical solution, it is possible to collect and move in a functional manner by means of said transfer device said first or second group of packagings.

Preferably, the movable lateral portion comprises a sheet-like element that is movable in translation by means of a carriage which is engaged on a horizontal track of said piston.

Preferably, said lateral portion is configured in such a way as to be able to flank said at least one web in said collection zone so as to be able to engage with said first or second group of packagings acting as a lower abutment surface on which said first or second group of packagings will rest and remain secured by gravity.

This solution allows an effective and precise movement by the transfer device of the first or second group of packagings.

Preferably, said transfer device with two degrees of freedom is a movable articulated parallelogram comprising a member and a projecting portion which is configured to act as a first retention element for said first or second group of packagings.

Thanks to this technical solution it is possible to make said transfer device move by acting on linkages in such a manner that it achieves the desired vertical and horizontal movements by actuating only one type of rotary actuator. In this way, the accelerations and the decelerations of the transfer device in space can be optimally and precisely controlled.

Preferably, said rotary actuator is a motor. More preferably, said rotary actuator comprises two motors which are housed at a first and a second pin.

Preferably, said projecting portion is a sheet-like element which is configured in such a way as to be able to flank said at least one web in said collection zone so as to be able to engage with said first or second group of packages acting as a lower abutment surface on which said first or second group of packages will rest and remain secured by gravity.

Preferably, said first movement device which brings said second group of packagings starts to move as soon as said transfer device has travelled a minimum vertical distance which is equal to or greater than the total of the height of a packaging of said plurality of packagings and the thickness of said first retention element which engages with said plurality of packagings.

Thanks to this technical solution, the process times required to carry out said multi-layered system can be further reduced, thereby increasing the productivity of the process.

Preferably, said multi-layered system is moved, once it has been completed, in the vertical direction and away from said transfer device. Preferably, such vertical movement allows said multi-layered system to be moved from said bundling zone to a movement zone wherein the multi-layered system is horizontally aligned with a second movement device.

This optimises the further step of movement of the multi-layered system for the desired subsequent processing steps, avoiding possible blockages in the transport line and undesirable damages to the transported packagings. In addition, this technical solution makes it possible to reduce and optimise the steric footprint of the transfer device by reducing its vertical stroke, thereby shortening its working step period and thus increasing the productivity of the process.

Preferably, said multi-layered system is moved in a second advance direction which is parallel with said first advance direction by means of said second movement device.

Thanks to this solution, it is possible to create a bundling unit that is even more ergonomic, compact and accessible for the operator.

Preferably, said first movement device comprises a first web and a second web which are mutually parallel and said first retention element is formed so as to be able to pass freely into the space between said first and second webs.

In this way the plurality of packagings can be conveyed even more precisely and effectively.

Preferably, said first movement device comprises a first actuator and a second actuator, which are independently actuatable and which are positioned upstream and downstream of said collection zone, respectively, and which are configured so as to be able to selectively engage and block a desired packaging of said plurality of packagings. Preferably, the packaging is blocked with respect to the motion of the first movement device.

In this way, it is avoided that the entire plurality of packagings exerts a pressure on the packagings located in the collection zone and that this pressure can move, as a result of elastic relaxation, the packagings immediately proximal to those in the collection zone when the first or second group is moved by means of said transfer device.

In other words, before the first or second group of packagings is moved by the transfer device, the packagings that make up the first or second group are separated from the load exerted by the upstream packagings and given the freedom to move reciprocally by relaxing any previously stored elastic compressions.

Preferably, said first movement device comprises a first and a second web which are formed and laterally spaced apart from each other so as to define between them a free zone, into which said retention element of said transfer device can pass.

In this way the plurality of packagings can be conveyed even more precisely and effectively.

Preferably, said transfer device with two degrees of freedom comprises a piston which is vertically movable in translation between said collection zone and said bundling zone, and said first retention element is a portion which is horizontally removable with respect to said piston and which is configured so as to be able to pass reversibly from an open configuration, in which it is near said collection zone, to a closed configuration, in which it does not intersect with said first movement device and/or said plurality of packagings.

Thanks to this solution, it is possible, in a simple and effective manner, to have a high adaptability of the transfer device to changes in the number of components of the groups of packagings by suitably varying the horizontal stroke of said removable portion.

Preferably, said transfer device with two degrees of freedom is a movable articulated parallelogram comprising a member and a projecting portion which is configured to act as a first retention element for said first or second group of packagings.

In this way, the desired accelerations and decelerations can be optimally and precisely controlled in certain positions in the space of the transfer device without compromising its functionality or service life.

Preferably, said bundling device has a box-like shape, comprises a lower opening which is formed so as to allow the passage of said first or second group of packagings, and wherein said second retention element comprises at least one shelf which is reversibly movable from a retracted configuration to an extended configuration, in which it at least partially occupies said lower opening so as to no longer allow the passage of said first or second group of packagings through it.

Thanks to this technical solution, it is possible to make the retention of the desired groups of packagings in the bundling zone easier and more effective creating a precise multi-layered packaging system.

Preferably, said at least one shelf passes from said retracted configuration to said extended configuration by horizontal movement.

In this way, process times can be minimised and optimised while reducing the possibility of interference with other movable parts.

Preferably, said bundling device comprises two shelves which are reversibly movable from said retracted configuration to said extended configuration and which are housed on opposite walls of said bundling device.

Thanks to this technical solution, the stability with which the packagings are secured in the accumulation zone is further improved and at the same time the passage of the various groups of packagings through said lower opening is facilitated when the two shelves are in a retracted configuration.

BRIEF DESCRIPTION OF THE DRAWINGS

The characteristics and advantages of the present invention will become clearer from the detailed description of a preferred embodiment thereof, illustrated by way of non-limiting example with reference to the accompanying drawings wherein:

FIGS. 1 to 7*a* are schematic side views of a bundling unit made in accordance with the present invention in various process configurations;

DETAILED DESCRIPTION OF THE INVENTION

Figure 1:
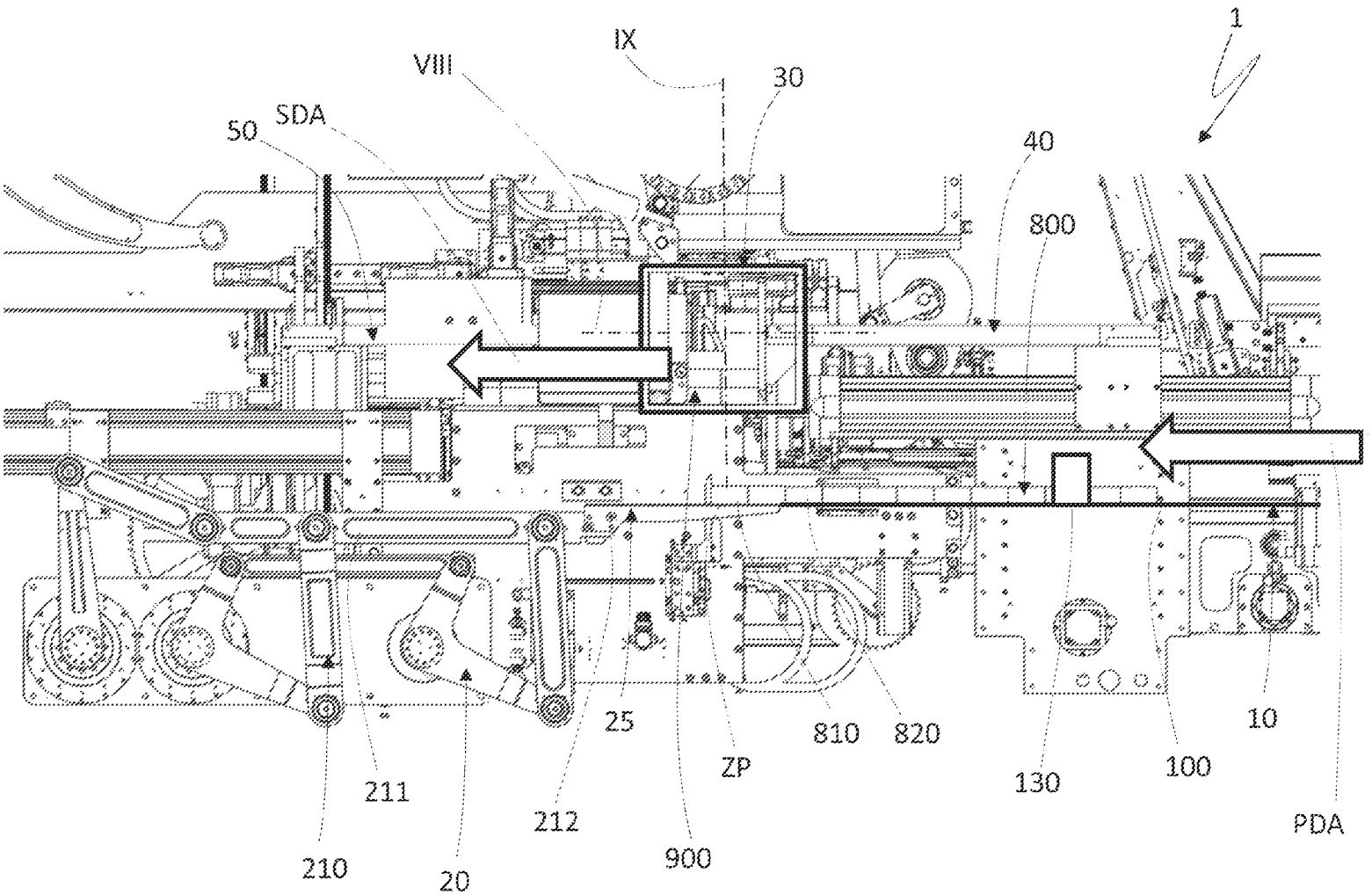

With initial reference to FIG. 1, 1 denotes a bundling unit for carrying out a multi-layered packaging system 900 starting from a plurality of packagings 800.

The embodiment example which will be described below refers to packagings, in particular box-like shaped in which articles are preferably arranged in an orderly manner, for example arranged on superimposed layers.

In the specific case described here, the articles with which the packagings are filled are capsule elements for the preparation of infusion beverages, in particular coffee capsules.

The bundling unit 1 comprises a first movement device 10 for said plurality of packagings 800, a transfer device 20 which is placed downstream of said first movement device 10 and a bundling device 30 which is placed downstream of said transfer device 20.

As shown in FIGS. 1 to 7*a*, 810 identifies a first group of packagings and 820 identifies a second group of packagings of the plurality of packagings 800.

By way of non-limiting example, FIGS. 1 to 7*a* show some of the steps of carrying out a multi-layered packaging system 900 which comprises two packagings for each of the two layers envisaged.

In this sense, therefore, this three-dimensional matrix representing the multi-layered packaging system 900 is of the two-row by two-column type.

Again with reference to FIGS. 1 to 7*a*, it can be noted that both the first group of packagings 810 and the second group of packagings 820 are each composed of two horizontally aligned packagings.

In the present example, 800 represents a plurality of parallelepiped-shaped packagings which is housed on a first and second web 110,120, which act as a first movement device 10.

Figure 7A:
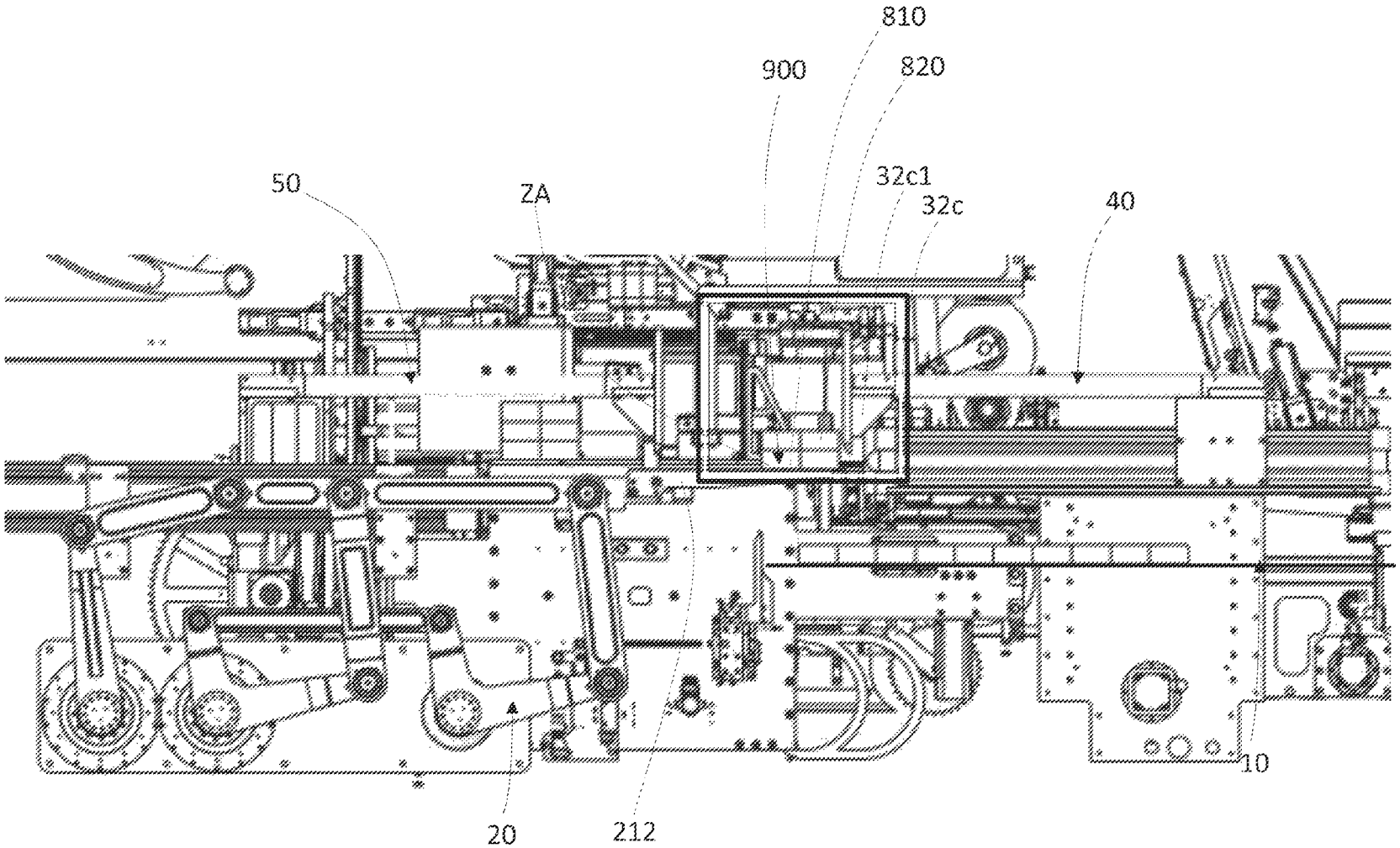
Figure 7B:
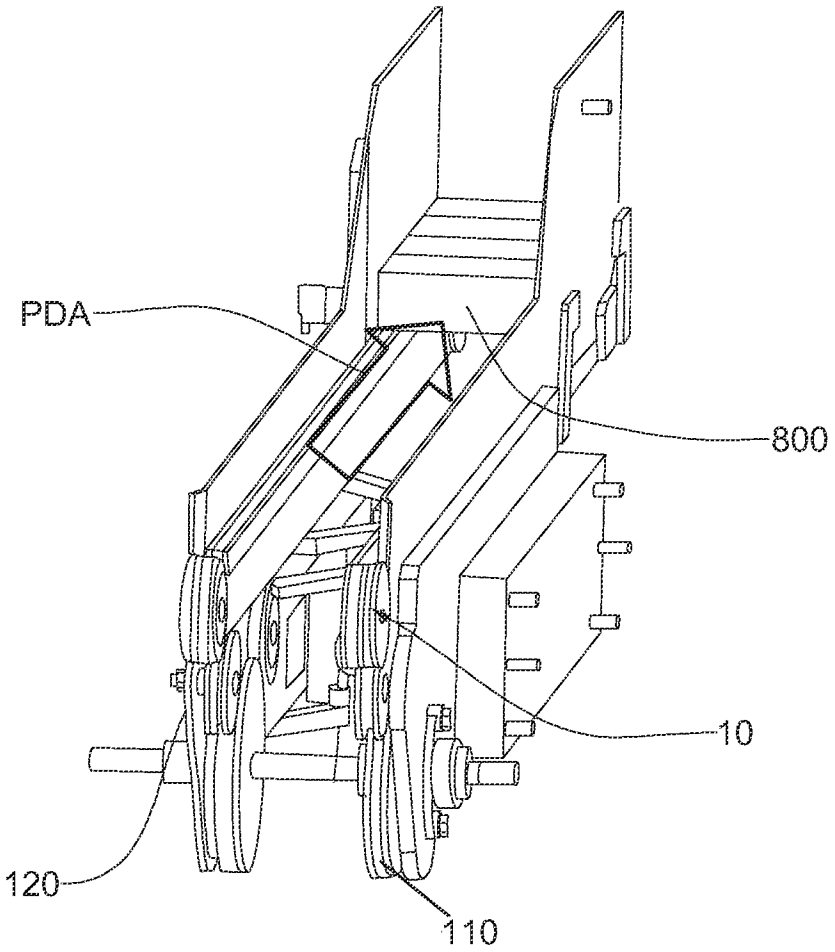
FIG. 7*b* is a schematic front perspective view of a detail of the bundling unit of FIG. 1, FIGS. 8*a* and 8*b* are schematic top views of a bundling device of the bundling unit according to section VIII of FIG. 1.

With reference to FIG. 7*b*, this first and second web 110,120 are arranged parallel, at the same height from the horizontal plane of the ground and define a same first advance direction PDA of said plurality of packagings 800.

Again, these first and second webs 110,120 are spaced apart by a spacing between about 90 mm and 200 mm.

This distance between the first and second webs 110, 120 is functional to allow the transfer device 20 to never collide with them while being able to effectively interact with the plurality of packagings 800.

With reference to FIG. 1, it can be noted that the first and second webs 110, 120 end in a collection zone ZP for the plurality of packagings 800.

Figure 2:
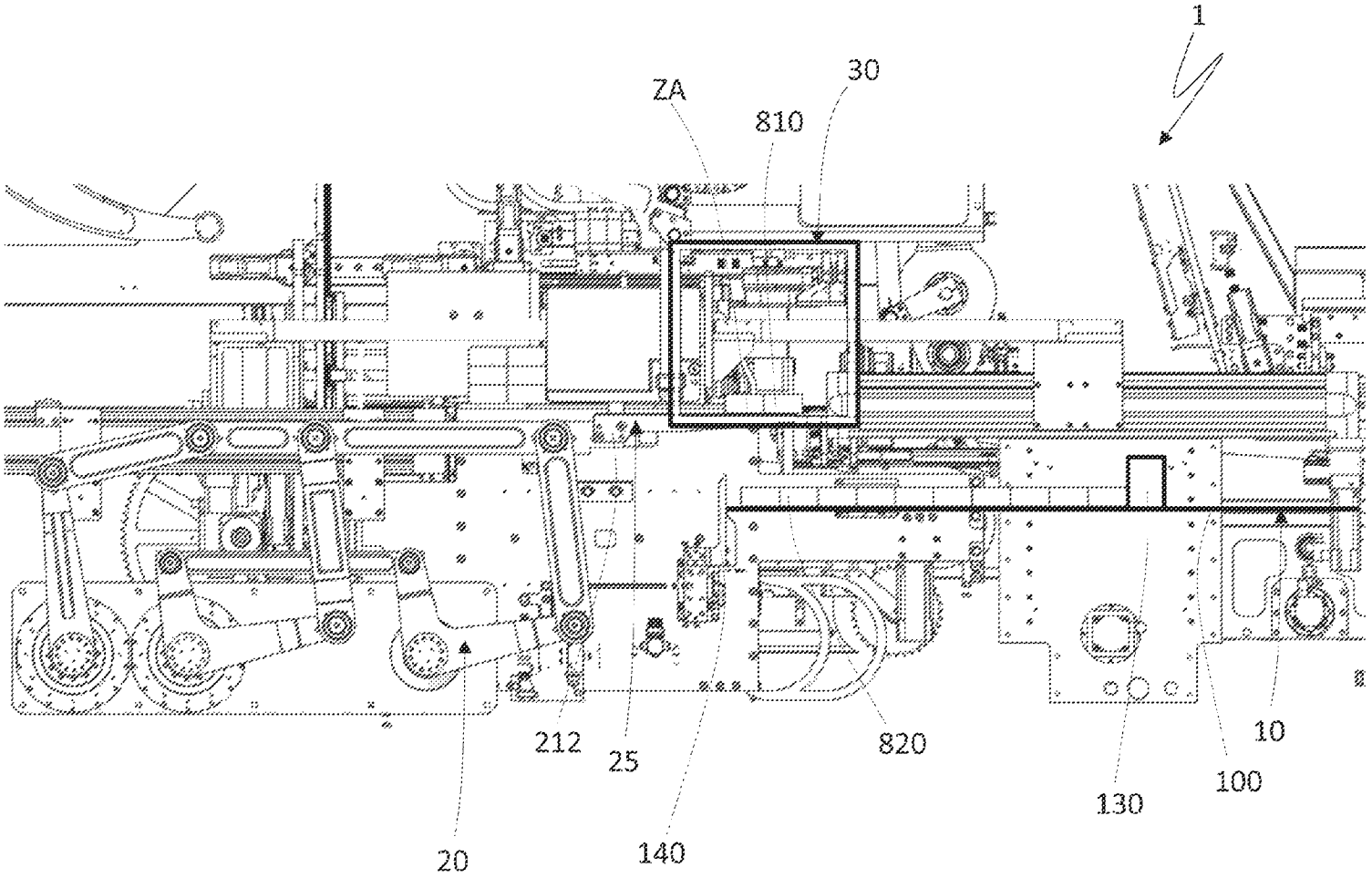

As shown in FIG. 2, the first movement device 10 comprises a first actuator 130 and a second actuator 140 which are placed upstream and downstream of the collection zone ZP, respectively.

The first actuator 130 is a piston which is placed in an upper proximity of the first and second web 110, 120 and is configured in such a way as to be able to extend horizontally in a direction which is substantially perpendicular to the first advance direction by engaging on a packaging transported by said first and second web 110, 120 and by blocking it on an opposite abutment wall.

When this first actuator 130 is actuated by blocking the desired packaging, all packagings downstream thereof are potentially free from the pressure that the plurality of packagings 800 previously exerted.

The second actuator 140 is also a piston which is connected to a horizontal plate and which is placed immediately downstream of the collection zone ZP.

Such a piston is configured in such a way as to be able to move reversibly in translation in the direction opposite to that of the first advance direction PDA, transiently acting as an abutment for said plurality of packagings 800.

When the piston of said second actuator 140 is moved in translation in the direction opposite to said first advance direction PDA it acts as an abutment for the plurality of packagings 800 which advances on the first and second web 110, 120.

When the piston of said second actuator 140 is moved in translation in accordance with the first advance direction PDA, i.e. away from said plurality of packagings 800, it grants additional space to the plurality of packagings 800 which can thus relax any residual elastic compressions.

This effect is even more evident when the second actuator 140 is moved away from the plurality of packagings 800 while the first actuator 130 is in operation. In fact, in this way only the packagings downstream in the point at which the first actuator 130 acts are disengaged from the chain of pressures present in the plurality of packagings 800 and can fully benefit from the additional space provided by the relative movement produced by the second actuator 140 thus relaxing the residual elastic compression energies.

In this respect it is interesting to note that the actual collection zone ZP that the packagings assume is the one reached following the aforesaid movement of the second actuator 140 thanks to which the residual compression energies of the packagings are relaxed.

With reference to FIG. 1, it can be noted that when the first group of packagings 810 (consisting of two aligned packagings) arrives in the collection zone ZP the transfer device 20 is positioned in such a way that it can collect it and move it towards a bundling zone ZA which is vertically aligned to said collection zone ZP.

As shown in FIG. 1, the transfer device 20 comprises a first retention element 25.

More in detail, this transfer device 20 comprises a movable articulated parallelogram 210 which comprises a member 211 and a projecting portion 212 which is configured to act as a first retention element 25 for said first or second group of packagings 810, 820.

Figure 3:
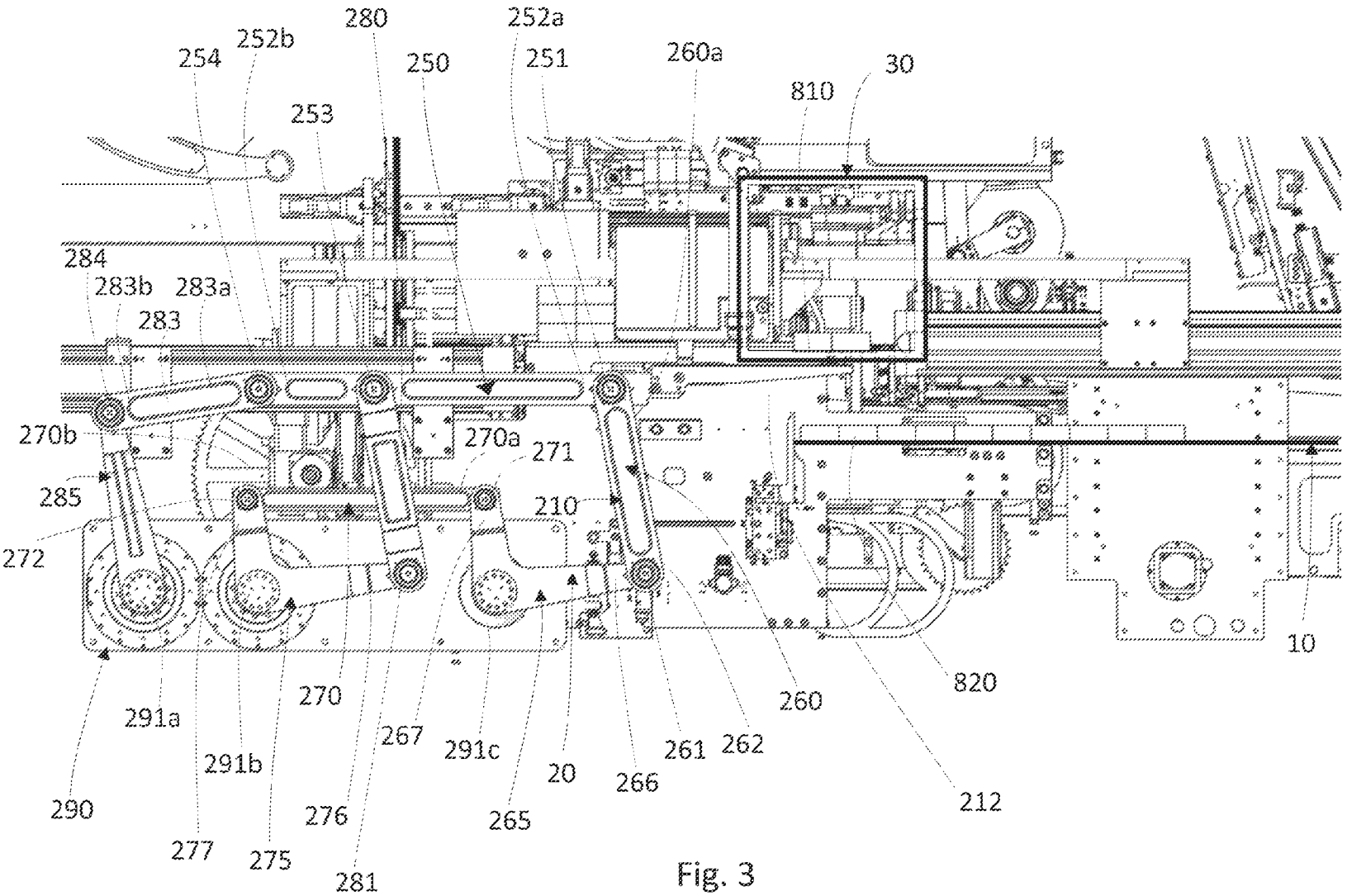

With reference to FIG. 3, it can be noted that this articulated parallelogram 210 is secured by means of linkages to an actuation element 290 comprising two motors (not shown in the figure) and three pins 291*a*, 291*b*, 291*c* of which the first and the second pin 291*a*, 291*b* are connected directly to the aforesaid two motors while the third pin 291*c* is neutral.

This articulated parallelogram 210 comprises a first rod 250 comprising a first hinge 251 which is placed near a first end 252*a* of the first rod 250 on which said projecting portion 212 which extends horizontally towards said plurality of packagings 800 is fixed.

This first rod 250 comprises a second hinge 253 which is placed at substantially a median zone thereof and a third hinge 254 which is placed at a second end thereof 252*b* which is opposite the first end thereof 252*a*.

The articulated parallelogram 210 comprises a second rod 260 which is secured with permitted rotation at a first end thereof 260*a* to the first rod 250 by means of said first hinge 251 and comprising a fourth hinge 261 which is placed near a second end thereof 262 which is opposite said first end 260*a*.

Again with reference to FIG. 3, the second rod 260 is secured by means of the fourth hinge 261 to a first linkage 265 having a substantially "L" shape.

This first linkage 265 is engaged with permitted rotation in a substantially median zone thereof on the third pin 291*c* and on a second end thereof 267*a*, opposite a first end thereof 266 connected to the fourth hinge 261, is secured with permitted rotation by means of a fifth hinge 271*a* on a third rod 270*a*.

This third rod 270*a* has a horizontal orientation and is parallel with that of the first rod 250.

Furthermore, as shown in FIG. 3, the third rod 270*a* comprises at a second end thereof 270*b*, opposite the first end thereof 270*a* which is bearing the fifth hinge 271*a*, a sixth hinge 272*a* which engages with permitted rotation on a second linkage 275*a*, which is formed like the first linkage 265, at a second end 277*a* of the latter.

This second linkage 275*a* is engaged on the second pin 291*b* of the second motor substantially at the median zone thereof and with a fourth rod 280 at a first end thereof 276*a*, opposite the second end 277*a*, by means of a seventh hinge 281.

The fourth rod 280 is secured with permitted rotation by means of the second hinge 253 on the first rod 250 at substantially the median position thereof.

As can be seen again from FIG. 3, in this way it is possible to make the first rod 250 move according to two degrees of freedom, which are the vertical axis and the horizontal axis, by keeping this first rod 250 always horizontal in space.

Thanks to this solution, also the projecting portion 212, which is integrally secured to the first rod 250 as an extension thereof, always remains horizontal in the space and acts as an ideal support plane for the various groups of packagings which are wished to be moved according to need.

Still with reference to FIG. 3, the third hinge 254 of the first rod 250, which is positioned at the second end thereof 252*b*, opposite first end thereof 252*a*, is secured with permitted rotation to a fifth rod 283 at the first end thereof 283*a*.

The fifth rod 283 is secured with permitted rotation by means of an eighth hinge 284 which is positioned near a second end 283*b* to a third linkage 285, having a rod-like shape, which is in turn secured with permitted rotation on the first pin 291*a*.

In this way, with the rotations of the first pin 291*a* which is directly connected to the first motor it is possible to define the main movement of the articulated parallelogram 210 according to the horizontal axis, while by means of the rotations of the second pin 291*b* which is directly connected to the second motor it is possible to manage the vertical movement of the articulated parallelogram 210 maintaining the desired orientation of the projecting portion 212.

FIGS. 1 to 9*b* with 30 show the bundling device of the packagings.

Figure 8B:
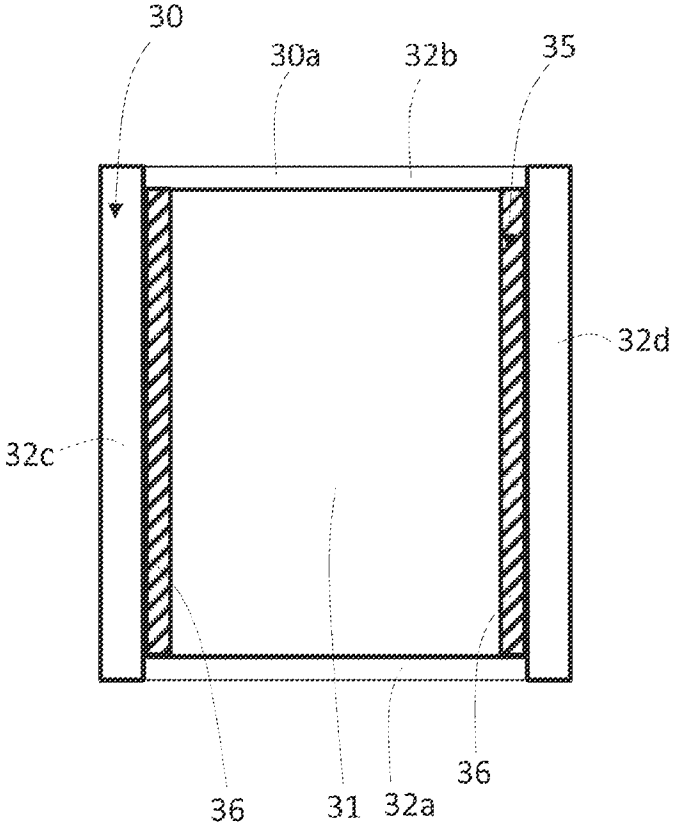
Figure 8A:
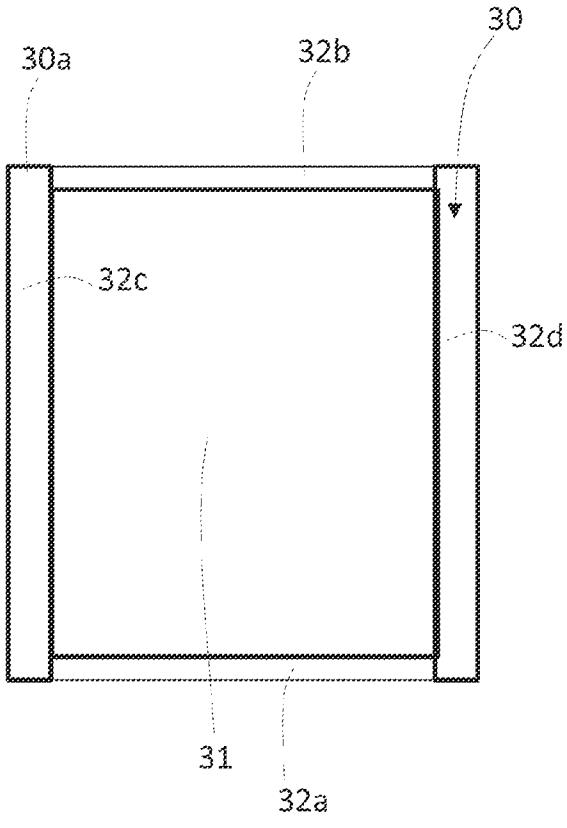

With specific reference to FIGS. 8*a* and 8*b*, it can be noted that this bundling device 30 comprises a central member 30*a* having a substantially box-like shape.

In more detail, the bundling device 30 has a central member 30*a* which is shaped so as to comprise a lower opening 31 which is placed in the centre of its lower face.

This lower opening 31 has a preferred rectangular shape and is sized to allow the passage through it of the various groups of packagings 810, 820 the bundling of which is wished.

In this sense, therefore, the dimensions of the lower opening 31 are close to those of the packagings to be bundled and their desired groups, taking into account however that the same bundling device 30 can be used for packagings of different formats.

As shown in FIGS. 8*a* to 9*b*, the central member 30*a* of the bundling device 30 comprises a first and second lateral faces 32*a*, 32*b* which are opposite each other and having a development which is substantially perpendicular to the first advance direction PDA and a third and fourth lateral faces 32*c*, 32*d* which are opposite each other and having a development which is substantially parallel to the first advance direction PDA.

The first lateral face 32*a* comprises a first lateral opening through which a rod 41*a* of a piston 41 of a second movement device identified with a pushing device 40 passes (see FIGS. 1 and 7*a*).

Similarly, the second lateral face 32*b* comprises a second lateral opening through which a rod 51*a* of a piston 51 of an abutment device 50 passes (see FIGS. 1 and 7*a*).

The third lateral face 32*c* has a third lateral opening 32*c*1 that allows an operator of the bundling unit 1 positioned beside the first and second web 110,120 to clearly see the various steps of bundling of the first and second group of packagings 810, 820 (see FIG. 7*a*).

Again with reference to FIGS. 8*a* to 9*b*, the third and fourth lateral faces 32*c*, 32*d* comprise in one of their lower portions a seat for respective shelves 36 acting as a retention element 35.

Figure 9B:
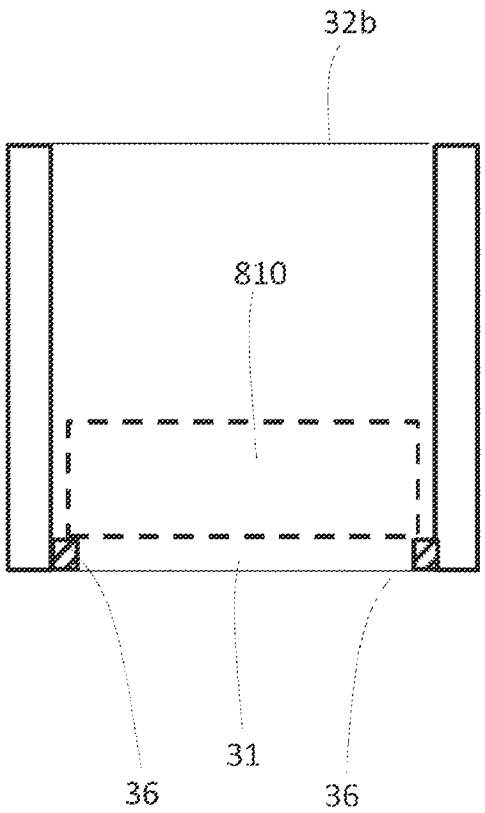
FIGS. 9*a* and 9*b* are schematic front views of said bundling device of the bundling unit according to section IX of FIG. 1.

As shown in more detail in FIGS. 8*b* and 9*b*, these shelves 36 can move in translation laterally outside respective seats which are obtained in the third and fourth lateral faces 32*c*, 32*d* projecting towards the central zone of the bundling device 30. In this way they reduce the effective extension of the lower opening 31 and are able to act as an abutment for the first or second group of packagings 810,820.

Figure 9A:
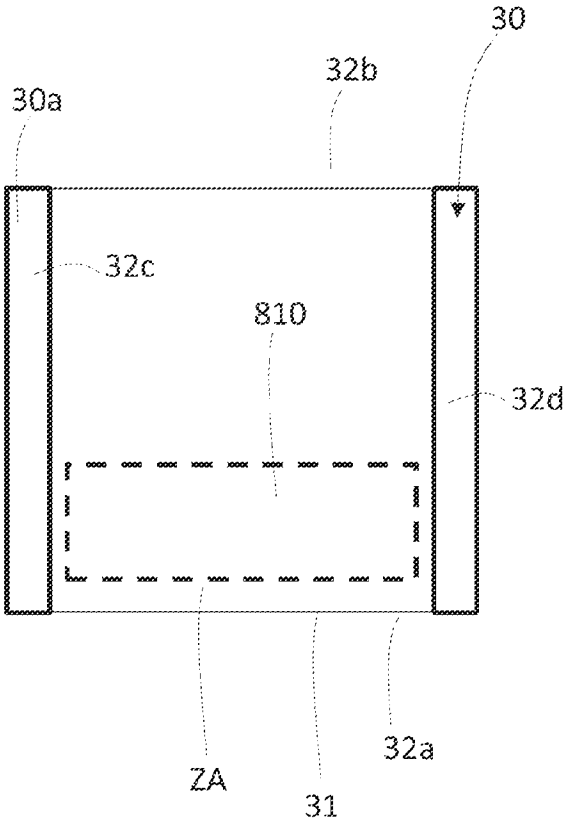

FIGS. 9*a* and 9*b* show the outline of a packaging by means of a dashed line, showing in particular in FIG. 9*b* how the packaging remains secured by force of gravity on the shelves 36 projecting from the respective third and fourth lateral wall 32*c*, 32*d*.

These shelves 36 are moved by means of a system with pistons which are connected to an electric motor or to a compressed air system or similar technical solutions.

The shelves 36 project from the internal surface of the third or fourth lateral wall 32*c*, 32*d* by about 12-15 mm+/−2 mm.

The bundling device 30 is secured with permitted vertical translational movement which is performed by means of pistons (not shown in the figure). In this way, it is possible to vertically move in translation the bundling device from a closed configuration, in which the bundling device 30 is at a minimum distance from the first movement device 10, to a spaced configuration, in which the bundling device 30 is at a maximum distance from the first movement device 10 and at the same level as the second advance direction SDA. When the bundling device 30 is in this spaced configuration, the multi-layered system 900 can be directly moved by the pushing device 40 described below without risking damaging the packagings being moved.

Figure 6:
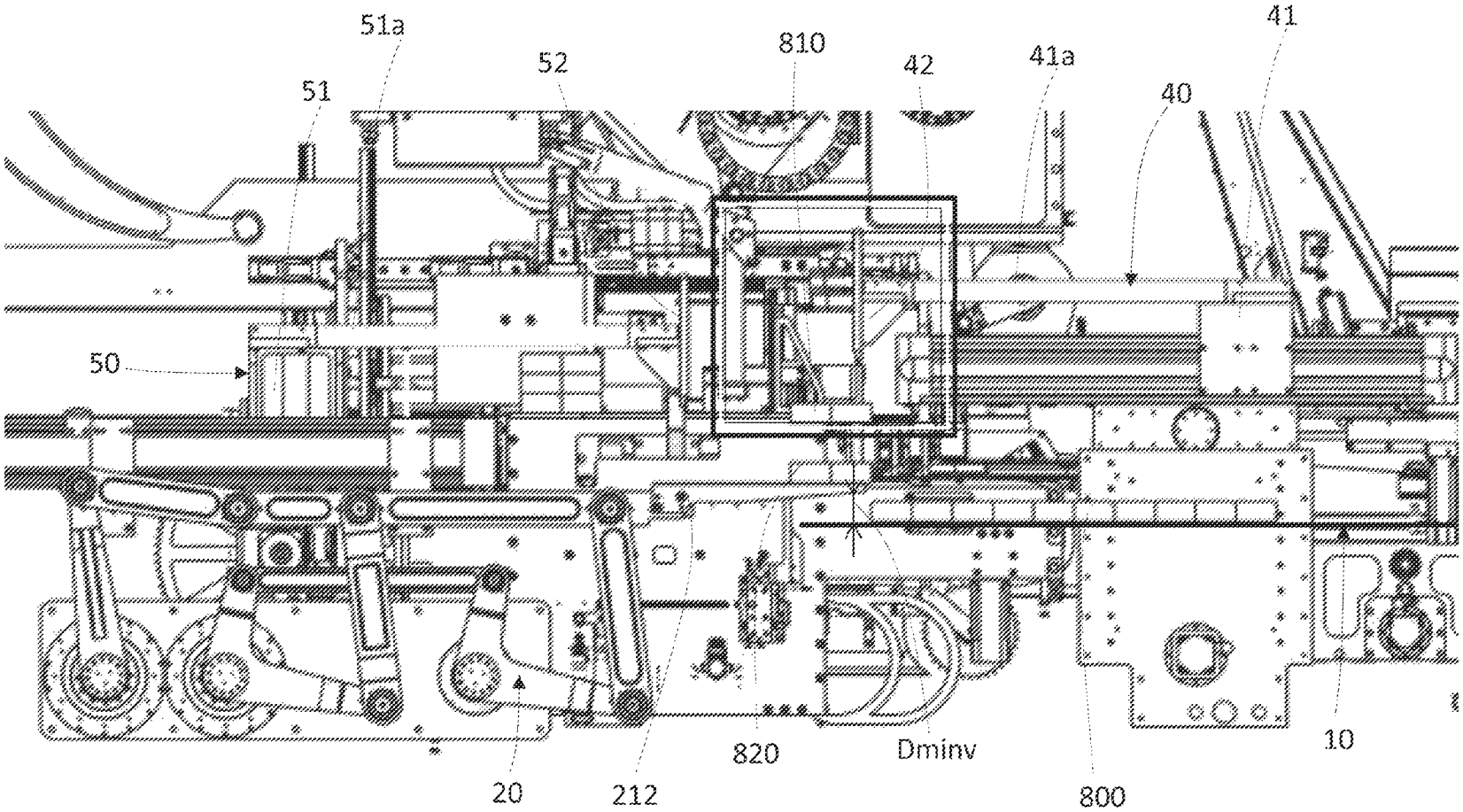

With reference to FIGS. 6 and 7*a*, the pushing device 40 comprises the rod 41*a* of the piston 41 at the end of which a vertical pushing wall 42 is integrally secured.

This vertical pushing wall 42 has a planar development which is parallel to the first lateral wall 32*a* and is formed in such a way as to be able to push the multi-layered packaging system 900 out of the bundling device 30 once the desired bundling operations have been completed.

In this sense, therefore, this vertical pushing wall 42 has a smaller surface development than the second lateral opening of the second lateral wall 32*b*.

Again with reference to FIGS. 6 and 7*a*, the abutment device 50 comprises the rod 51*a* of the piston 51 at the end of which a vertical abutment wall 52 is integrally secured.

This abutment wall 52 has planar development which is parallel to the first lateral wall 32*a* and is formed in such a way as to be able to abut the multi-layered packaging system 900 when it is pushed out of the bundling device 30 once the bundling operations have been completed by the vertical pushing wall 42.

In this sense, therefore, this vertical abutment wall 52 has a smaller surface development than the second lateral opening of the second lateral wall 32*b*.

When the multi-layered packaging system 900 is completely bundled, the vertical pushing wall 42 and the vertical abutment wall 52 cooperate by moving in translation until the aforesaid multi-layered packaging system 900 is brought into a boxing position, which is located downstream of the bundling device 30, wherein said multi-layered packaging system 900 is inserted into a box-like container.

The bundling device 30 comprises sensors, preferably optical, configured so as to verify that the multi-layered packaging system 900 reaches and does not surpass a predetermined height relative to a specific and desired three-dimensional matrix.

If the parameter detected by the aforesaid sensors is not met, the multi-layered packaging system 900 is considered as a waste and both the pushing wall 42 and the abutment wall 52 are made to move in translation to an unloading position, which is different from the previously described boxing position, in order to be transferred to an unloading station. At the unloading position there is housed an unloading device that moves the multi-layered packaging system 900 out of the bundling and boxing line in order to collect it in the aforementioned unloading station.

With reference to FIG. 1, it can be noted that the plurality of packagings 800 is moved in the first advance direction PDA through the first and second web 110, 120.

In this way, the first group of packagings 810 of the plurality of packagings 800 arrives in the collection zone ZP which is identified on the first and second webs 110, 120. The first actuator 130 is activated by blocking a packaging and preventing all the pressure of the packagings aligned in the first advance direction PDA from being applied to the first group of packagings 810. At the same time, the second actuator 140 (see also FIG. 2) is also activated, which, by moving relatively away from the first and second web 110, 120, allows the first group of packagings 810 to relax any accumulated elastic compression energies, thus reaching the final position at the collection zone ZP.

At this point, and still with reference to FIG. 1, the articulated parallelogram 210 with the projecting portion 212 is positioned so as to be able to collect the first group of packagings 810 from below by inserting itself between the first and second web 110, 120.

Subsequently, the articulated parallelogram 210 moves thanks to the motion imposed by the first and second pin 291*a*, 291*b* moving the first group of packagings 810 towards the bundling zone ZA.

While this is happening, the bundling device 30 brings the shelves 36 into a retracted configuration so that the first group of packagings 810 can pass through the lower opening 31 and completely surpass the bundling zone ZA.

With reference to FIGS. 2 and 3, it can be noted how the projecting portion 212 brings the first group of packagings 810 vertically beyond the bundling zone ZA, thus allowing the shelves 36 to pass to the extended configuration, thus being able to stably block the first group of packagings 810 in the desired position and at the same time being able to further move the articulated parallelogram 210.

It is interesting to note, again with reference to FIG. 2, that while the articulated parallelogram 210 reaches and surpasses the bundling zone ZA, the first and second actuator 130, 140 have been deactivated and the first and second web 110, 120 have already started to move so as to bring the second group of packagings 820 in the collection zone ZP.

With reference to FIG. 6, it can be noted that the first and second web 110, 120 preferably start to move the first or second group of packagings 810, 820 again as soon as the projecting portion 212 of the articulated parallelogram 210 has travelled a vertical movement greater than a minimum vertical distance Dminv equal to the height of the packaging plus the thickness of the projecting portion 212.

Once the second group of packagings 820 has arrived at the collection zone ZP, the first and second actuator 130, 140 are activated again in order to prevent, also in this case, that there may be excessive elastic compression energy inside the packagings to be treated.

With reference to FIG. 3, it can be noted that the articulated parallelogram 210 starts to move away from the bundling device 30 by initially descending vertically.

Figure 4:
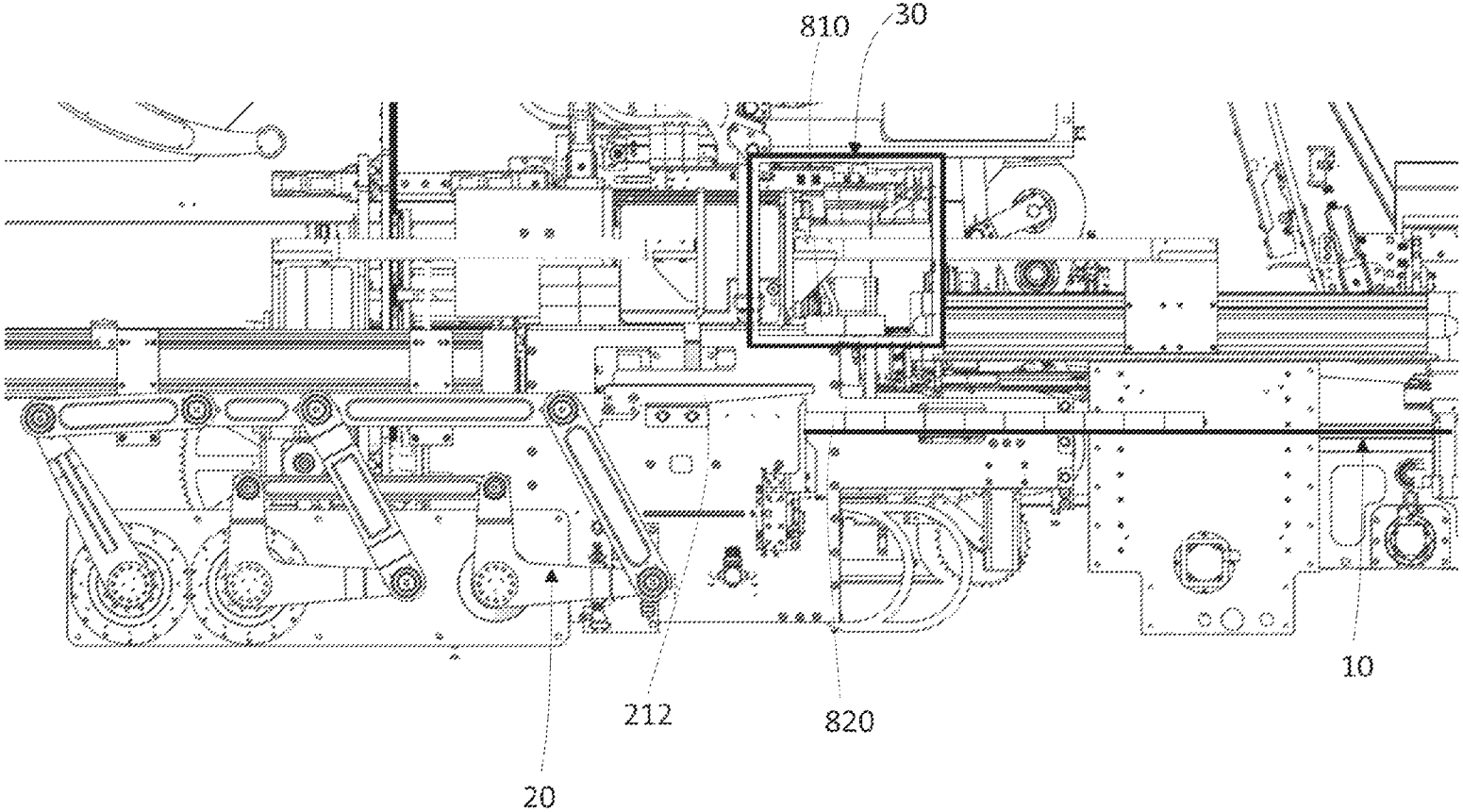

With reference to FIG. 4, it can be noted how the articulated parallelogram 210 descends along a path with a vertical component and a horizontal component, moving away from the first and second web 110, 120 and from the portion of the initial vertical trajectory that it had followed to bring the first group of packagings 810 into the bundling zone ZA.

This movement allows the articulated parallelogram 210 to approach the first and second web 110, 120 and the second group of packagings 820 without crossing the collection zone ZP, in order not to run the risk of possible collisions and optimising process timings.

Figure 5:
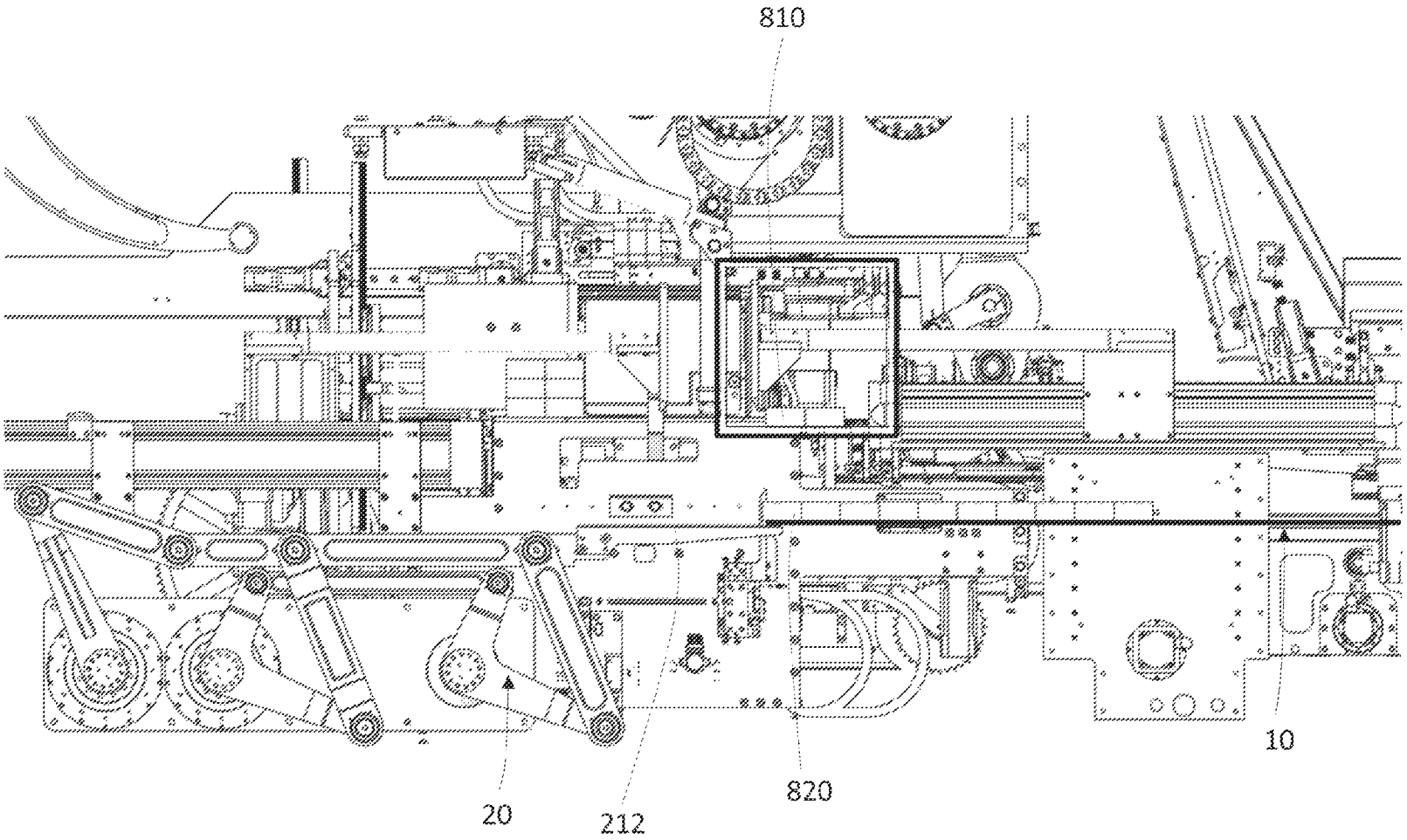

With reference to FIG. 5, it can be noted how the articulated parallelogram 210 has arrived near the second group of packagings 820 and is proceeding horizontally so as to be inferiorly aligned with the second group of packagings 820 to be collected.

With reference to FIG. 6, it can be noted how the articulated parallelogram has collected the second group of packagings 820 and is bringing it towards the bundling zone ZA. It can further be noted that the first and second web 110, 120 start to move again as soon as the articulated parallelogram 210 has surpassed the minimum vertical distance Dminv previously described.

With reference to FIG. 7*a*, it can be noted that the first group of packagings 810 has been bundled with the second group of packagings 820 following the passage in the retracted configuration of the shelves 36 which have allowed the second group of packagings 820 to pass through the lower opening 31 abutting inferiorly on the first group of packagings 810 and thus creating the desired multi-layered packaging system 900.

With reference again to FIG. 1, it can be noted that while the articulated parallelogram 210 is located so as to be able to collect the first group of packagings 810, a multi-layered system 900 is already ready in the bundling device 30. At this point, the pushing device 40 moves in translation the pushing wall 42 horizontally on a reference plane so as to make the multilayer system 900 come out of the bundling device 30 and to move it as far as said boxing zone.

In order to ensure that the multi-layered packaging system 900 does not undesirably surpass the boxing zone, the abutment wall 52 of the abutment device 50 also moves in translation consistently stopping at the end of the boxing zone (see FIG. 2).

With reference to FIG. 6, it can be noted that the pushing wall 42 returns to the initial position previously assumed before pushing the multi-layered packaging system 900 outside the bundling device 30 while the first group of packagings 810 has already been secured to said bundling device 30 in the bundling zone ZA. In order to do so, it is noted that the pushing device 40 moves in translation vertically superiorly by a sufficient minimum height which is greater than the height of the first packaging unit 810 the pushing wall 42 while returning it to the aforesaid initial position. In this way, processing times can be further reduced increasing the productivity of the bundling unit.

What is claimed is:

1. A method for carrying out a multi-layered packaging system, comprising:

providing a plurality of packagings, moving said plurality of packagings in a first advance direction (PDA) by a first movement device, bringing a first group of packagings of said plurality of packagings into a collection zone (ZP) located entirely on said first movement device, with said first group of packagings being supported on said first movement device in said collection zone (ZP), providing a transfer device having at least two degrees of freedom comprising a first retention element for said first group of packagings, collecting by said transfer device said first group of packagings while said first group of packagings is in said collection zone (ZP) and supported by said first movement device, moving said transfer device, while it retains said first group of packagings, in accordance with a vertical component towards a bundling zone (ZA) of a bundling device which is positioned in a vertical projection of said collection zone (ZP), activating a second retention element of said bundling device so as to collect said first group of packagings from said transfer device and to retain it selectively and stably in said bundling zone (ZA), moving said transfer device into said collection zone (ZP) while always maintaining a minimum distance different from zero with said first movement device and/or said plurality of packagings, starting to move said first movement device so as to bring a second group of packagings towards said collection zone (ZP) before said transfer device arrives in said collection zone (ZP), completing the movement of said first movement device as far as said collection zone (ZP) for said second group of packagings, moving said transfer device in accordance with a vertical component by bringing said second group of packagings into said bundling zone (ZA) of said bundling device while said second retention element is deactivated in such a manner that said second group of packagings vertically moves said first group of packagings by taking the position thereof and thereby forming said multi-layered packaging system.

2. The method according to claim 1, wherein said transfer device with two degrees of freedom has the ability to move along two axes which are contained in a vertical plane which is defined by a vertical axis and said first advance direction (DA).

3. The method according to claim 2, wherein said transfer device with two degrees of freedom is a movable articulated parallelogram comprising a member and a projecting portion which is configured to act as said first retention element for said first or second group of packagings.

4. The method according to claim 1, wherein said first movement device comprises at least one web.

5. The method according to claim 1, wherein said transfer device with two degrees of freedom comprises a piston which is vertically movable in translation and on which there is secured with permitted horizontal translational movement a movable lateral portion which is configured to act as said first retention element.

6. The method according to claim 4, wherein said first movement device comprises a first web and a second web which are mutually parallel and said first retention element is formed so as to be able to pass freely into the space between said first and second webs.

7. The method according to claim 1, wherein said first movement device which brings said second group of packagings starts to move as soon as said transfer device has travelled a minimum vertical distance (Dminv) which is equal to or greater than the total of the height of a packaging of said plurality of packagings and the thickness of said first retention element which engages with said plurality of packagings.

8. The method according to claim 1, wherein said multi-layered system is moved in a second advance direction (SDA) which is parallel with said first advance direction (PDA).

9. The method according to claim 1, wherein said first movement device comprises a first actuator and a second actuator, which are independently actuatable and which are positioned upstream and downstream of said collection zone (ZP), respectively, and which are configured so as to be able to selectively engage and block a desired packaging of said plurality of packagings.

10. A bundling unit for carrying out a multi-layered packaging system comprising:

a first movement device for moving a plurality of packagings in a first advance direction (PDA) comprising a collection zone (ZP) located entirely on said first movement device, a transfer device having two degrees of freedom, of which one is vertical, and comprising a first retention element for collecting a first group of packagings of said plurality of packagings in said collection zone (ZP) while said first group of packagings is supported on said first movement device in said collection zone (ZP), said transfer device being positioned downstream of said first movement device, a bundling device which is positioned in a vertical projection of said collection zone (ZP) and which comprises a second retention element which is configured so as to selectively retain said first group of packagings in a bundling zone (ZA), said transfer device being configured to move reversibly from said bundling zone (ZA) to said collection zone (ZP) while always maintaining a minimum distance different from zero with said first movement device.

11. The bundling unit according to claim 10, wherein said first movement device comprises at least one web.

12. The bundling unit according to claim 10, wherein said first movement device comprises a first and a second web which are formed and laterally spaced apart from each other so as to define between them a free zone, into which said retention element of said transfer device can pass.

13. The bundling unit according to claim 10, wherein said transfer device with two degrees of freedom comprises a piston which is vertically movable in translation between said collection zone (ZP) and said bundling zone (ZA) and said first retention element is a portion which is horizontally removable with respect to said piston and which is configured so as to be able to pass reversibly from an open configuration, in which it is near said collection zone (ZP), to a closed configuration, in which it does not intersect with said first movement device and/or said plurality of packagings.

14. The bundling unit according to claim 13, wherein said transfer device with two degrees of freedom has the ability to move along two axes which are contained in a vertical plane which is defined by a vertical axis and said first advance direction (PDA).

15. The bundling unit according to claim 10, wherein said transfer device with two degrees of freedom is a movable articulated parallelogram comprising a member and a projecting portion which is configured to act as a first retention element for said first and second group of packagings.

16. The bundling unit according to claim 10, wherein said bundling device has a box-like shape, comprises a lower opening which is formed so as to allow the passage of said first or second group of packagings, and wherein said second retention element comprises at least one shelf which is reversibly movable from a retracted configuration to an extended configuration, in which it at least partially occupies said lower opening so as to no longer allow the passage of said first or second group of packagings through said lower opening.

17. The bundling unit according to claim 10, wherein said first movement device which brings said second group of packagings starts to move as soon as said transfer device has travelled a minimum vertical distance (Dminv) which is equal to or greater than the total of the height of a packaging of said plurality of packagings and the thickness of said first retention element which engages with said plurality of packagings.

18. The bundling unit according to claim 10, wherein said multi-layered system is moved in a second advance direction (SDA) which is parallel with said first advance direction by means of a second movement device.

19. The bundling unit according to claim 10, wherein said first movement device comprises a first actuator and a second actuator, which are independently actuatable and which are positioned upstream and downstream of said collection zone (ZP), respectively, and which are configured so as to be able to selectively engage and block a desired packaging of said plurality of packagings.

* * * * *